United States Patent [19]

Gandolfi et al.

[11] 4,209,291

[45] Jun. 24, 1980

[54] SAFETY APPARATUS FOR STOPPING GAS LEAKAGES

[75] Inventors: Maria L. Gandolfi, Travagliato; Maria L. Bonaga, Fraz.Candia, both of Italy

[73] Assignee: Barbara Horvath, Madrid, Spain

[21] Appl. No.: 912,843

[22] Filed: Jun. 5, 1978

[30] Foreign Application Priority Data

Sep. 26, 1977 [IT] Italy ..... 27934 A/77

[51] Int. Cl.[2] ..... F23N 5/24

[52] U.S. Cl. ..... 431/16; 431/22; 73/23

[58] Field of Search ..... 431/16, 22; 73/23, 40.5 R

[56] References Cited

U.S. PATENT DOCUMENTS

| | | | |
|---|---|---|---|
| 2,585,882 | 2/1952 | Weissman et al. | 431/16 |
| 3,295,585 | 1/1967 | Kovach et al. | 431/22 |
| 3,582,247 | 6/1971 | Faure | 431/22 |

*Primary Examiner*—Carroll B. Dority, Jr.

*Attorney, Agent, or Firm*—Diller, Ramik & Wight

[57] ABSTRACT

A safety and warning apparatus for detecting gas leakages in private and work premises, is disclosed, in which the improvement consists in providing an explosion chamber in which a miniature deflagration is caused to occur in a chamber in which ambient air is supplemented with a specific gas rate of flow. The miniature explosion chamber is connected to an overlying pilot flame chamber so that as soon as the miniature blowup occurs, the pilot flame is blown out and a temperature sensing means is capable of commanding the gas cutoff, the energization of an alarm signal, or both.

6 Claims, 1 Drawing Figure

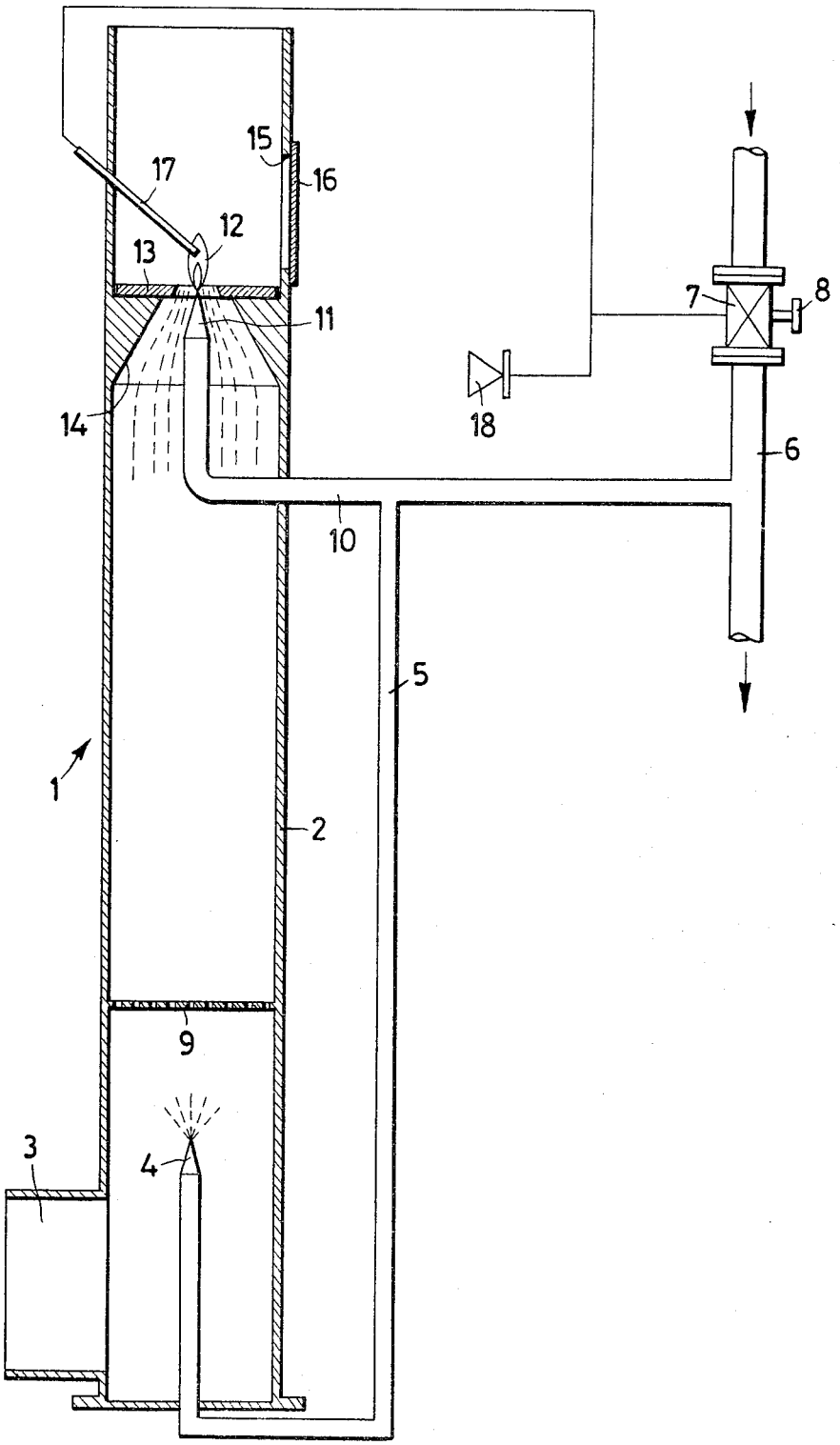
15
16
17
12
13
11
14
7
8
18
6
10
5
1
2
9
3
4

SAFETY APPARATUS FOR STOPPING GAS LEAKAGES

This invention relates to an apparatus which can be applied to in installation for feeding fuel gas (for example town gas or methane) in order to afford safety against the occurrence of dangerous situations which may derive from gas leakages.

The dangers are known which are inherent in an accidental gas leakage in an environment in which the gas is dispensed, be it a dwelling environment or a work place. The first hazard is that of deflagration, and the violence is sometimes such as to cause not only casualties among the people staying in the vicinity but also the serious damage of the entire building or a part thereof.

An object of the present invention is that to provide an apparatus which, in the case of a gas leakage is capable of entering action so as to prevent that the degree of saturation capable of originating deflagration may be attained, by forestalling it with appropriate cutoffs of the gas dispersing and/or generation of alarm signals.

According to the invention, this object is achieved by an apparatus which is characterized in that it comprises a gas-air mixing chamber equipped with a port for drawing-in the ambient air and means for feeding-in a preselected rate of flow of such fuel gas, means for priming a deflagration which are adapted automatically to originate a deflagration of the gas-air mixture formed in said chamber when the percentage of gas contained in said mixture attain the flammability boundary of such a mixture and deflagration detecting means adapted to respond to the deflagration of said mixture by the production of command signals for stopping the dispensing of gas by such gas feeding system and/or by the generation of alarm signals.

Stated another way, the apparatus according to the invention is based on the principle of anticipating, in the interior of the apparatus itself, by adding a supplementary amount of gas to the ambient air which might already contain leakout gas, the attainment of gas concentrations which are capable of originating a blowout. Before blow-up occurs with disastrous results for the surroundings, the deflagration is caused to occur on a reduced scale in the interior of the apparatus, wherein it confines its effects to the beneficial consequence of determining via the deflagration-detecting means the stoppage of the dispensing of gas and/or the delivery of alarm signals.

For example, the deflagration priming means can be composed by a pilot flame which is lighted above the admixing area of the ambient air and the supplementary gas and the deflagration detecting means can consist of a thermoelectric transducer (for example a thermocouple) arranged in the vicinity of such pilot flame so as to be capable of detecting the instant of time in which the anticipatory deflagration in the interior of the apparatus causes the pilot flame to be extinguished.

Priming means and deflagration detecting means of different types can anyhow be promptly used, and also the deflagration can be caused to take place in the admixing chamber itself, of in a discrete deflagration chamber superposedly arranged relative to the admixing chamber and in communication therewith.

The characteristics of the present invention can better be understood by the scrutiny of the ensuing detailed description of a possible practicable embodiment thereof as illustrated by way of example in the single FIGURE of the accompanying drawing which shows a sectional view of the gas leakage detection apparatus.

The apparatus depicted in the drawing, wherein it has been generally indicated at 1, comprises a tubular body 2, acting as an admixing and deflagration chamber, which is open at its top and is equipped, at the bottom, with a port 3 for drawing-in ambient air.

In the vicinity of the drawing-in port 3, there is inserted, in the interior of the tubular body 2, a flameless jet 4, which is appropriately calibrated as a function of the gas which is being used. Such a jet is put in communication, via the duct 5, with a piping 6 for feeding the fuel gas to the utilization appliances, downstream of a cutoff valve 7 which is equipped with a pushbutton or knob 8 for the manual opening. A wire gauze 9 is placed in the interior of the tubular body 2 above the jet 4 and above the draw-in port 3.

Another duct 10 establishes a communication between the piping 6, still downstream of the cutoff valve 7, and a second jet 11 for the pilot flame 12, the latter jet being also housed in the interior of the tubular body 2 well above the flameless jet 4 in an area which is fitted with turbulence-generating means: these are exemplarily embodied by a foraminous diaphragm 13 which rests on an inwardly projecting annular ledge 14 of the tubular body 2.

In correspondence with the pilot flame 12, which can be lighted with a match or another firing means introduced through a window 15 fitted with a door 16, there is arranged a thermocouple 17, which, until the flame is lighted, keeps the valve 7 open, while, in the case of extinction, it controls the closure of the valve 7 and the energization of an alarm signal 18.

The operation of the apparatus shown in the drawing is as follows: the pilot flame 12 is lighted, in the first place, by keeping the pushbutton 8 pressed: it ensures the necessary opening of the cutoff valve 7. The pushbutton 8 will then be released as the pilot flame 12 has heated the thermocouple 17 to such an extent as to keep the valve 7 open.

The pilot flame 12 causes a flue draft along the tubular body 2 and a consequential negative pressure so as to draw, via the port 3, ambient air to which supplementary gas is continuously added as fed with a constant rate of flow by the jet 4. The diaphragm 13 originates such a turbulence as is necessary for that additional gas stream to be correctly burned by the pilot flame 12.

The additional gas stream as delivered by the jet 4 originates in the interior of the tubular body 2 a mixture of air and gas having a preselected percentage enrichment with gas corresponding to the rate of flow that the jet 4 is capable of delivering.

In the case of methane, the jet 4 could be selected, for example, so as to produce a gas enrichment as high as by 3% by volume.

The result is that, in the case of a gas leakage from the utilization appliances, and well before that in the ambient air a gas concentration is produced which is enough to cause a blow up (for example 5.3% under ambient temperature and pressure for methane), a limited concentration of gas in the ambient air (2.3% in the case in point) is sufficient for being added to that due to the integrator jet 4 and to attain the concentration level which corresponds to the flammability limit of the gas.

At this stage the pilot flame 12 will prime the blow up in the interior of the tubular body 2 between the flame and the wire gauze 9: the latter is intended for preventing the deflagration wave may reach the nozzle 4 and kindle it.

Due to the deflagration, the pilot flame 12 is blown out so that the thermocouple 17 is cooled and causes the closure of the cutoff valve 7 along with the delivery of an alarm signal by the signalling device 18.

In the case in which, due to unusual reasons, the pilot flame is not blown out, the cycle will automatically be renewed and the safety will be provided that the desired result will reliably be obtained.

What is claimed is:

1. A safety apparatus against gas leakage in a system for feeding fuel gas, characterized in that it comprises a chamber for admixing gas to air equipped with a port for drawing in ambient air and means for feeding a preselected rate of flow of fuel gas, means for priming a blow up adapted automatically to originate the deflagration of the gas-air mixture formed within said chamber when the percentage of gas contained in the mixture attains the flammability limit of the mixture and means for detecting the deflagration adapted to respond to the deflagration of said mixture along with the production of command signals for cutting off the gas feed by said gas feeding system and/or for generating an alarm signal.

2. An apparatus according to claim 1, characterized in that said mixing chamber is composed by an elongate tubular body open at the top and equipped in its bottom section with a suction port, said feeding means being composed by a flameless gas jet connected to said gas feeding system and housed in said chamber in the vicinity of said suction port, said priming means being a jet with a pilot flame connected to said fuel gas feeding system and housed in said chamber in a location above said suction port and said flameless jet.

3. An apparatus according to claim 2, characterized in that it comprises turbulence-generating means associated with said mixing chamber in the vicinity of said pilot flame jet.

4. An apparatus according to claim 2, characterized in that it comprises a separation wire gauze screen inserted in said chamber between either jet and the other one.

5. An apparatus according to claim 2, characterized in that said deflagration detecting means are composed by a thermoelectric transducer placed near said pilot flame jet for sensing the status of lighting or extinction of the pilot flame.

6. An apparatus according to claim 5, characterized in that said thermoelectric transducer is a thermocouple.

* * * * *